US005785396A

United States Patent [19]

Israel

[11] Patent Number: 5,785,396

[45] Date of Patent: Jul. 28, 1998

[54] GLOVE BAG

[76] Inventor: Hal C. Israel, 2200 Station Dr. Suite #2, Camden, N.J. 08104

[21] Appl. No.: 832,226

[22] Filed: Apr. 3, 1997

[51] Int. Cl.[6] ..... A61G 11/00

[52] U.S. Cl. ..... 312/1

[58] Field of Search ..... 312/1, 3, 4, 5

[56] References Cited

U.S. PATENT DOCUMENTS 4,783,129 11/1988 Jacobson .
4,812,700 3/1989 Natale .
4,901,743 2/1990 Hittler .
5,017,197 5/1991 McGuire et al. .
5,147,242 9/1992 Lowe, Jr. ..... 312/1
5,536,077 7/1996 Ross ..... 312/1

*Primary Examiner*—Jose V. Chen
*Assistant Examiner*—Gerald A. Anderson
*Attorney, Agent, or Firm*—Zachary T. Wobensmith, III

[57] ABSTRACT

A glove bag for use in removing or other hazardous material from pipes and other structures such as beams, which includes a double piece spreadable bag with a center portion that fits around the structure which is covered by asbestos or other hazardous material, flaps, glue and tape to seal the bag around the structure, gloves for the worker to put his hands to handle the hazardous material and provisions for introduction of a wand to spray the material with water.

6 Claims, 7 Drawing Sheets

FIG. 3A
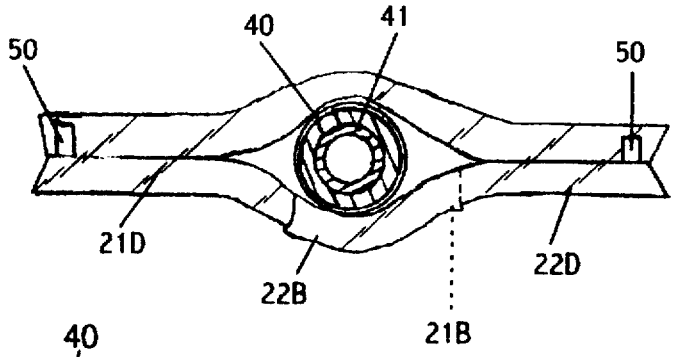
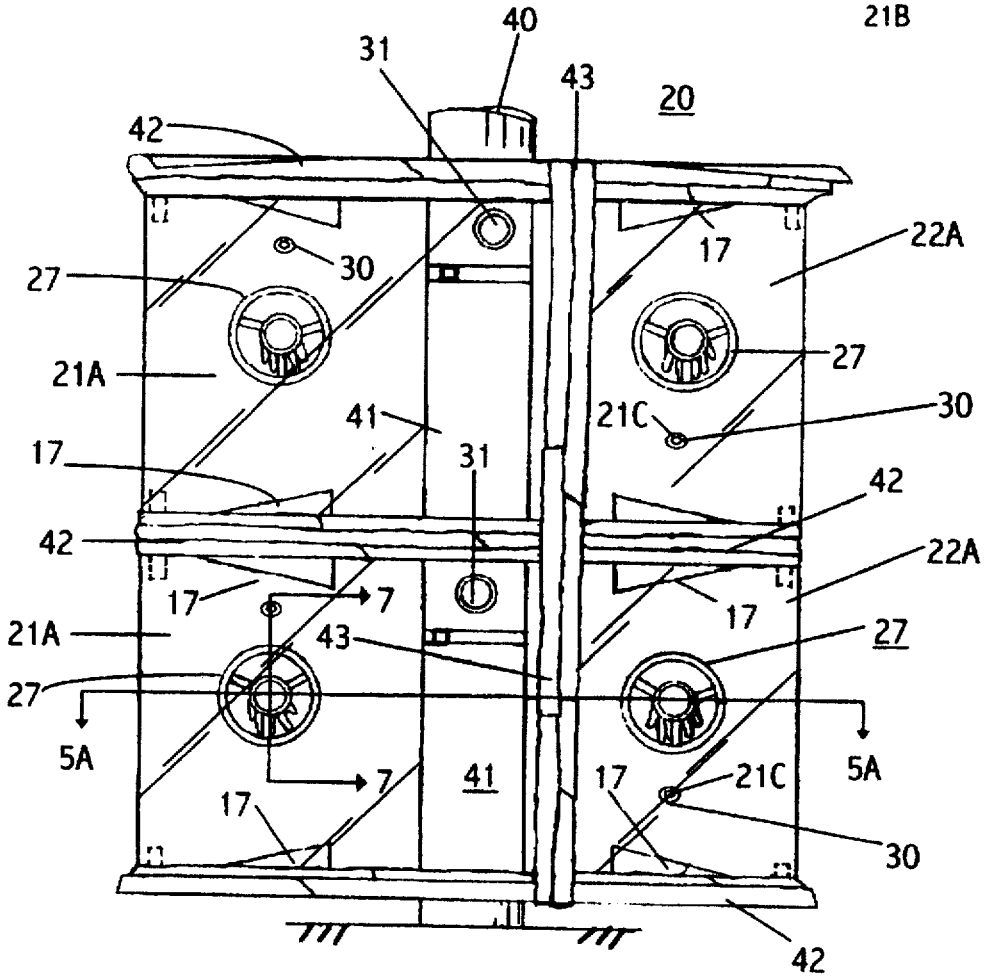
FIG. 3

FIG. 5A
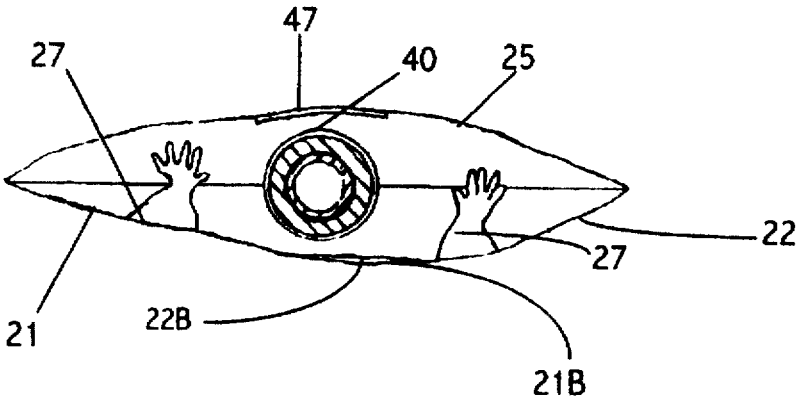
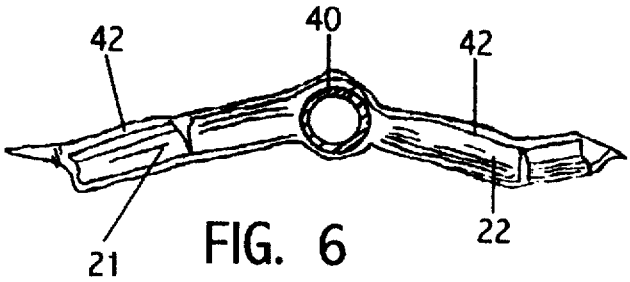
FIG. 6
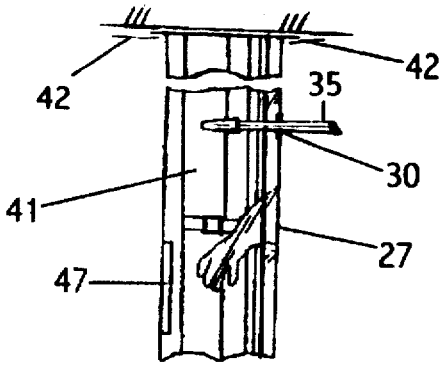
FIG. 7

FIG. 8
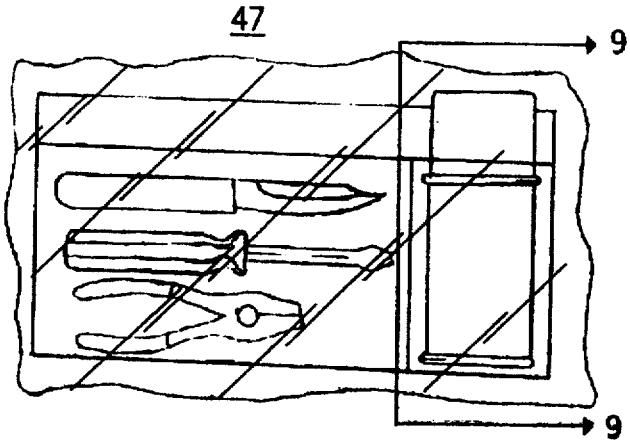
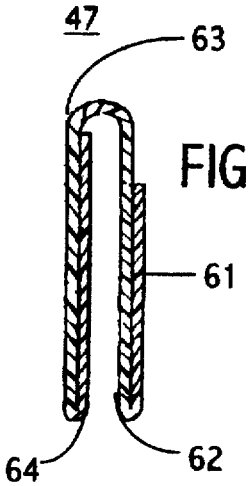
FIG. 9A
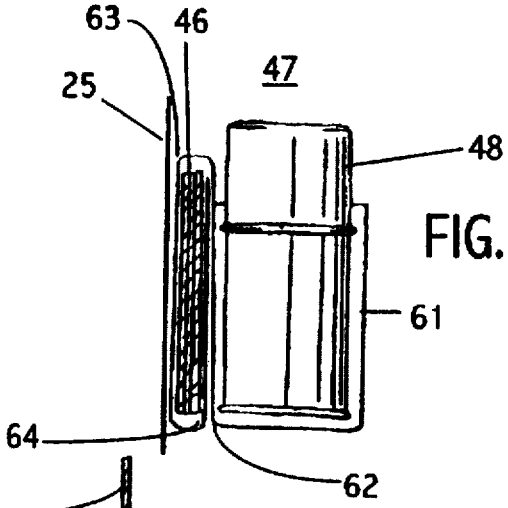
FIG. 9
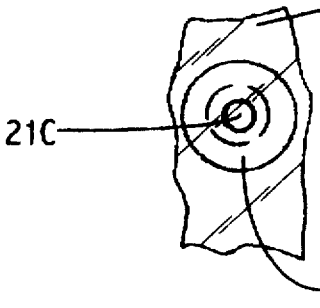
FIG. 10A
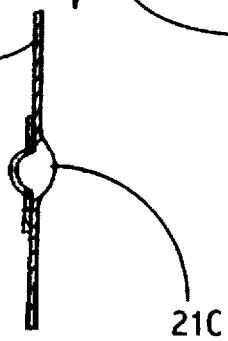
FIG. 10
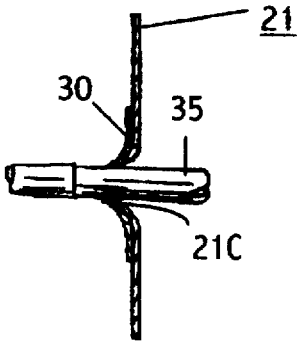
FIG. 11

GLOVE BAG

BACKGROUND OF THE INVENTION

1 . Field of the Invention

This invention relates to a glove bag of the type which is self contained, and which fits around the structure from which asbestos or hazardous materials are to be removed.

2. Description of the Prior Art

The removal of asbestos and other hazardous material from pipes, beams and other structures has become a large undertaking. The common method used in removing asbestos is to enclose the entire area, after which containers are provided to fit and contain the removed material, which can be a very cumbersome and tedious job for structures such as pipes or beams that extend vertically and/or horizontally, that are difficult to get to for removal of hazardous material, which results in preparing small containments i.e., the hazardous material is collected and placed in many small containers, rather than larger ones which adds to the labor and cost in removing the hazardous material in addition to the common method used of enclosing the entire area. Various structures have been proposed to solve the removal problems, such as shown in the U.S. Pat. No. 4,783,129; to Jacobson, Natale No. 4,812,700; Hittler No. 4,901,743, and McGuire No. 5,017,197, but none of them is entirely satisfactory, which are complicated, require heat sealing, or are not easily attached or detached from the structures, or are limited in their use to pipes, or are not supplied in a continuous line with ease of detachment of individual bags for disposal, or require the user to assume a crouching position in using the bags.

It is desirable to have a device that can fit over and seal off the structure from which the hazardous material is to be removed, with the enhancement of being safer, with a faster and easier method of applying, containing and removing the material for disposal, and is useful by a small work force. The device of the invention does not suffer from the shortcomings of the previous devices and provides many positive advantages.

SUMMARY OF THE INVENTION

It has now been found that a glove bag is available that is useful in many situations where it is tedious and difficult to form fit pipes, beams and various structures for hazardous material containment and removal, and which provides for small work-force operation with hazardous material completely contained during and subsequent to removal.

The principal object of the invention is to provide a glove bag that fits around the hazardous material and safely contains it after removal.

The further object of the invention is to provide a glove bag that saves time and money in hazardous material removal.

A further object of the invention is to provide a glove bag that is easy to use and can be used with a variety of structures.

A further object of the invention is to provide a glove bag that can be joined to other glove bags and carried in a container, in continuous form for multiple or one-at-a-time dispensing.

A further object of the invention is to provide a glove bag that permits water to be sprayed within without compromising the integrity of the glove bag.

A further object of the invention is to provide a comfortable working environment with ease in retrieving gloves in the bag which are held in place and ready for use.

DESCRIPTION OF THE DRAWINGS

The nature and characteristic features of the invention will be more readily understood from the following description taken in connection with the accompanying drawings forming part hereof in which:

FIG. 3 is a view similar to FIG. 1 illustrating the glove bag of the invention in place on a pipe that is covered with asbestos to be removed;

FIG. 3A is a top view in partial section, illustrating the glove bag of the invention in place on a pipe that is covered with asbestos to be removed;

FIG. 5A is a vertical sectional view taken approximately on the line 5A—5A of FIG. 3;

FIG. 6 is a vertical sectional view taken approximately on the line 6—6 of FIG. 4;

FIG. 7 is a vertical cross-sectional view taken approximately on the line 7—7 of FIG. 3 and broken away to illustrate the wand entry into the bag for water spraying;

FIG. 8 is a fragmentary view in partial phantom, illustrating the tool and towel pouch portion of the glove bag of the invention;

FIG. 9 is a horizontal sectional view taken approximately on the line 9—9 of FIG. 8;

FIG. 9A is a vertical cross-sectional view of an empty tool and towel pouch portion of the glove bag of the invention;

FIG. 10 is a vertical cross-sectional view taken approximately on the line 10—10 of FIG. 1A showing the water panel wand entry area, FIG. 10A is a front fragmentary elevational view of the water panel portion of the glove bag of the invention, and FIG. 11 is a view similar to FIG. 10 showing an actual wand inserted through the water panel of FIG. 10.

Figure 1:
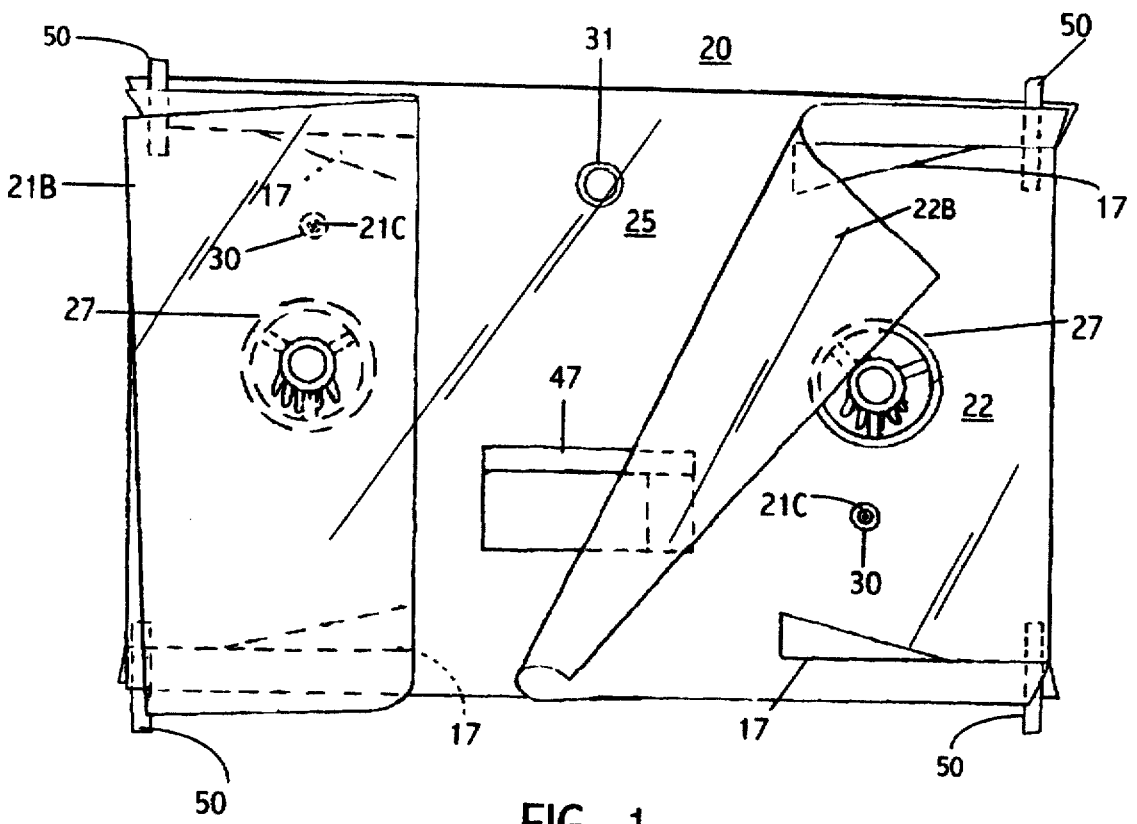
FIG. 1 is a front elevation view of a single flap open glove bag of the invention.
Figures 1A, 1B, 2:
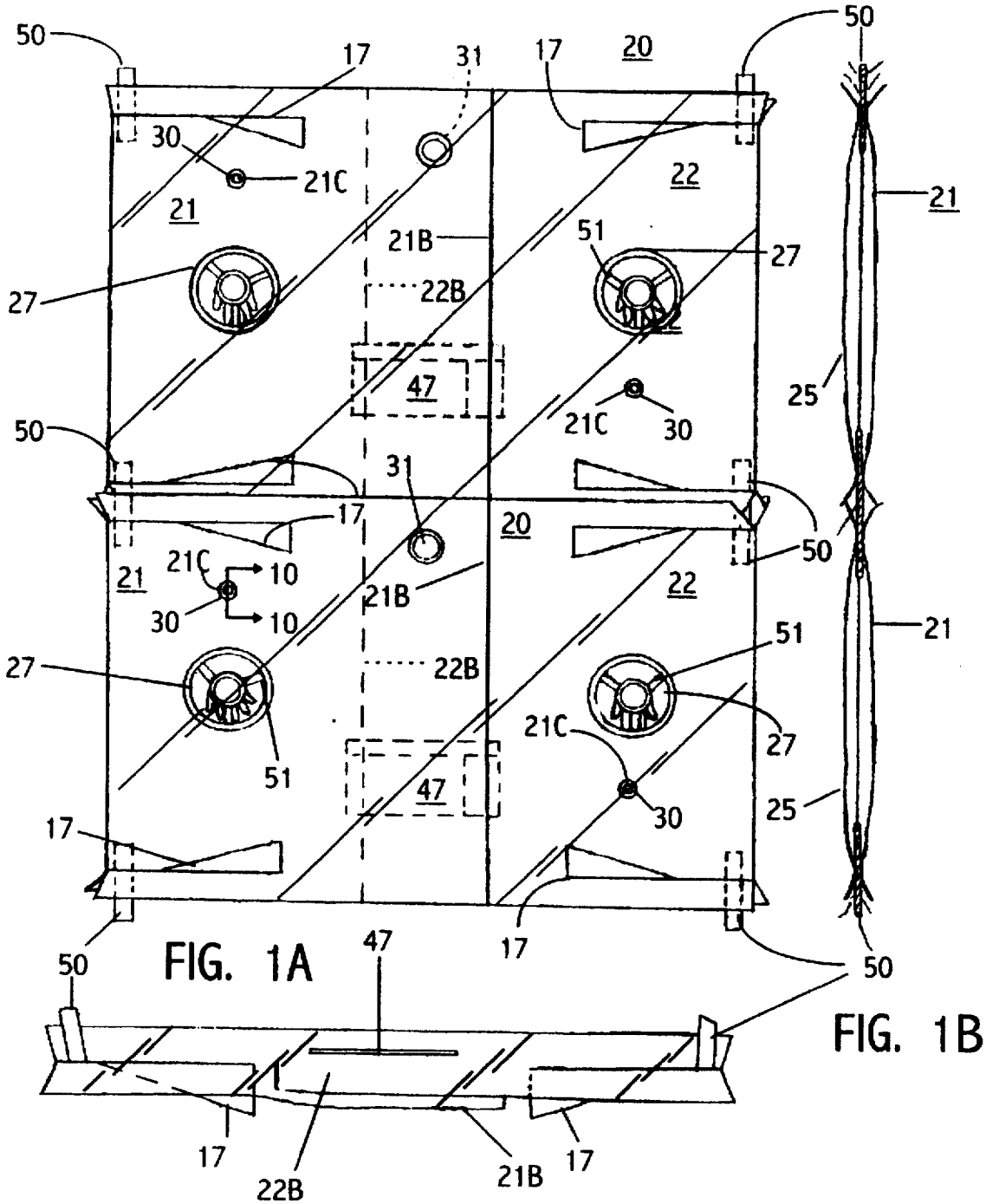
FIG. 1A is a front elevation view of two joined glove bags of the invention.
FIG. 1B is a side elevation view of two joined glove bags of the invention.
FIG. 2 is a top plan view of the glove bag of FIG. 1.
Figure 4:
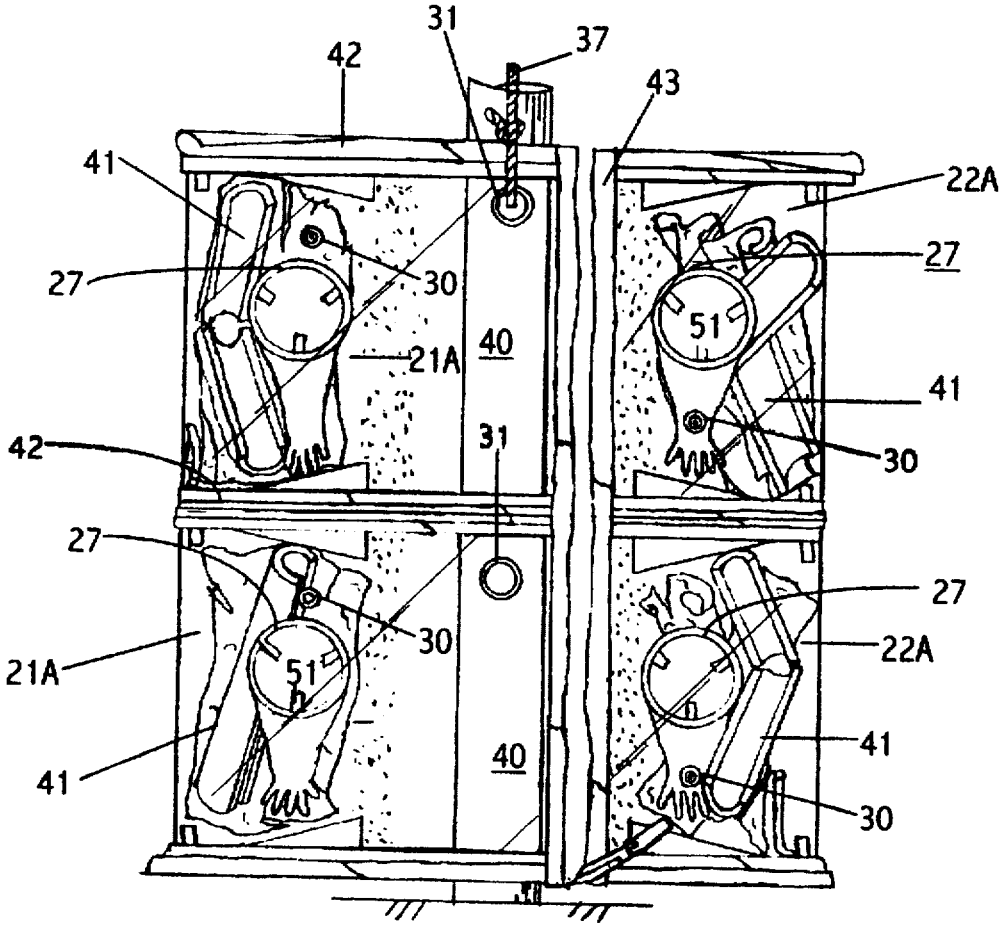
FIG. 4 is a view similar to FIG. 3 but broken away to illustrate asbestos covering removal as the bags are being cut down.

It should, of course, be understood that the description and drawings herein are merely illustrative and that various modifications, combinations and changes can be made in the structures disclosed without departing from the spirit of the invention.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Referring now more particularly to FIGS. 1–3, 7, 10, 10A, and 11 of the drawings, the glove bag 20 of the invention is therein illustrated. The glove bag 20 is constructed of plastic such as polyethylene, and is of two compartment construction 21A and 22*a* with front panels 21, 22, having overlapping flaps 21B, 22B, and 21D, 22D and a back panel 25, having overlapping flaps 25D, which are joined together to form the glove bag 20 with geometric fusion lines 17, to retain the compartments together along their meeting edges, which permits easy molding or forming of the bags around the hazardous material to be removed and forming the two self-contained i.e., which do not require additional structure for use compartments 21A and 22A. The bags 20 are held together by connector tabs 50, which can be broken to split the bags apart, or used to hold the bags together to allow for easy dispensing and application of a line of glove bags. The panels 21 and 22 are each provided with a glove 27 to receive the worker's hands (not shown) and permit handling of hazardous materials inside of the bag 20 without skin contact. The gloves 27 have connector tabs 51 that retain them for easy retrieval and ready for use and which may be broken to free the gloves 27 for use. The panels 21 and 22 are also provided with a water panel 30, which is of a self-sealing circular elastic material, with a hole in the center, placed behind a bubble of thin mil plastic 21C to permit entry of a wand 35 therethrough whereby water panel 30 collapses or constricts to grip and seal around the tool due to the elasticity of the self sealing elastic material to form a seal as shown in FIGS. 7 and 11, to spray water (not shown) into the bags interior.

The panels 21 and 25 are provided with reinforced portions 31 of greater strength than the rest of the panel and which are punctured to receive a rope 37 for supporting and lowering the bag 20.

Referring additionally to FIGS. 4, 5, 6, 8, and 9, the glove bag 20 as seen in FIG. 3 is engaged with a pipe 40 which has an outer covering 41 of asbestos. To install the bag 20, it was opened like a jacket i.e., the flaps 21D, 22D,21B, 22B were folded back and then folded around the pipe 40 and spray glue (not shown) and strips of tape 42 and 43 were applied across the top and bottom overlapping flaps 21D, 22D, and across the back top and bottom overlapping flaps 25D and down the front flaps 21B, 22B and sealed.

Figure 5:
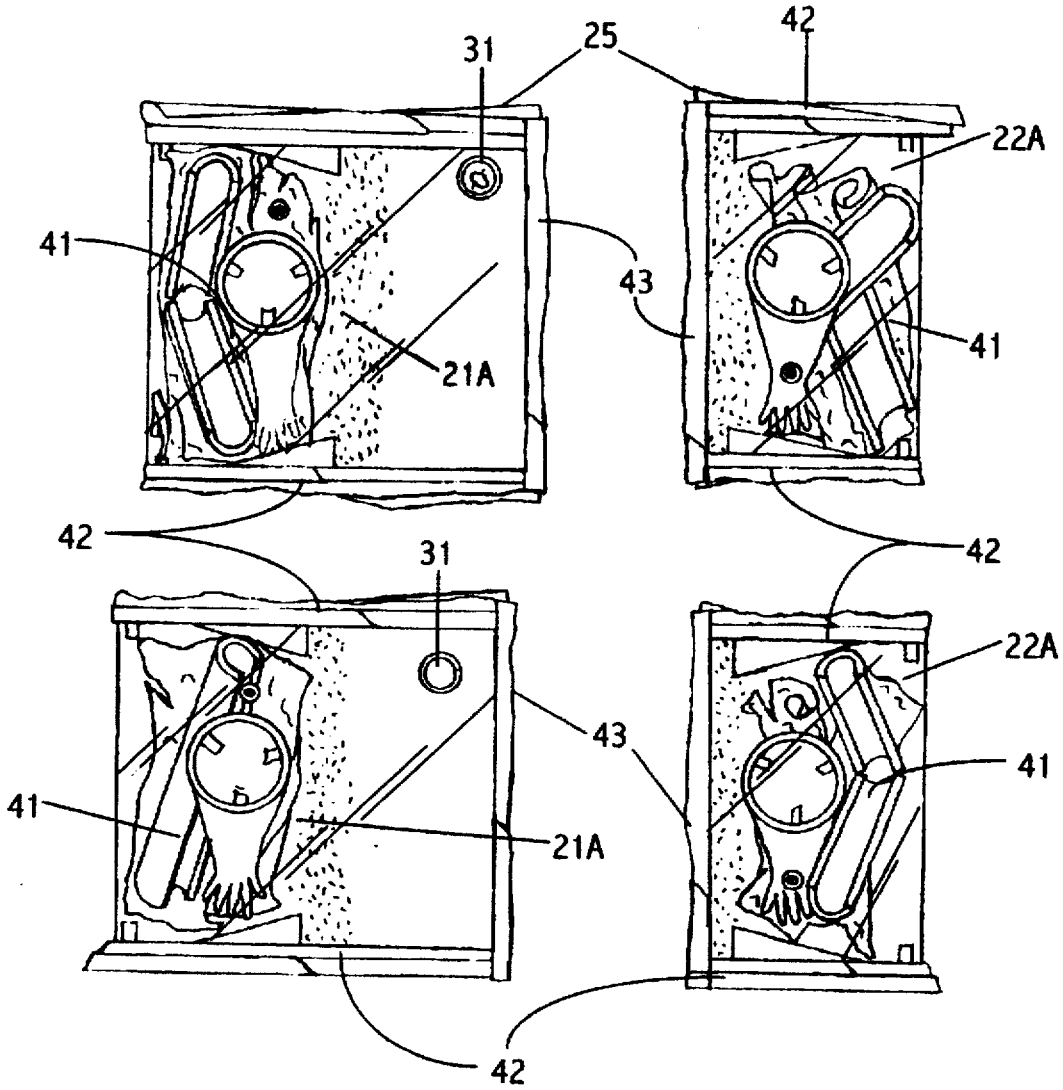
FIG. 5 is a view similar to FIG. 4, but with the glove bag removed from the pipe and all compartments split and separated.

The worker (not shown) inserts his hand in the glove 27, breaking tabs 51, respectively in compartments 21A and 22A and can then grasp and break off portions of the covering 41, and place them respectively in the compartments. The wand 35 is inserted in bubble 21C, where it is permitted to pass through the self-sealing water panel 30, and water is sprayed over the asbestos. Paper towels 46 are removed from pouch 47 and the compartments dried. The water panel 30 is then taped to seal it off. The compartments 21 A and 22A are spray glued using glue from can 48 to seal the compartments, and cut down the front along tape 43 to remove them from the structure. After this is done each individual bag was split down the back panel 25 and across along the tape 42, to provide four compartments, as shown in FIG. 5, that can be disposed of in the approved manner.

Referring additionally to FIGS. 8, 9, and 9A, the tool and towel pouch 47 is made of plastic such as polyethylene, and constructed with a four panel, three part fold, with side seams, which produces a double pouch designed to keep towels 46 dry, as front panel 61 folds up, providing a back panel 62 to a front pouch, and is divided into two compartments for tools and spray glue, with side seams to complete the front tool pouch, as it continues to fold down to provide the panel 63 rear pouch, and folding up to produce front panel 64 rear pouch. Front panel 64, folds up close to the top edge of the front pouch's back panel fold to keep water out, with side seams to complete the rear towel pouch.

It is thus apparent that a glove bag has been provided with which the objects of the invention are achieved.

I claim:

1. A glove bag for containment and removal of hazardous materials from a structure that form-fits around and conforms to the structure which comprises at least two separable compartments in said bag in contact with and encircling said structure;

at least one glove in each of said compartments to receive a hand of a worker;

said glove having breakable connector tab means to hold the glove in place for easy retrieval;

water entry means to permit water to be introduced into said compartments;

means to retain said compartments together along their meeting edges and;

means for sealing off said compartments in contact with said structure.

2. A glove bag as defined in claim 1 which has reinforced plastic portions to receive a rope for tying off the top of the glove bag and for lowering the bag.

3. A glove bag as defined in claim 1 which includes compartment for storing tools and towels which is, constructed of polyethylene plastic and of a 4 panel, 3 part fold, with side seams to produce a double tool and towel pouch, which is designed to keep the towels dry.

4. A glove bag as defined in claim 1 in which said water entry means includes a water panel, a circular self-sealing elastic material with a hole in the center in said water panel, a bubble of a thin plastic, over the hole in said water panel, for insertion of a wand into and through said bubble to provide water to the interior of said compartment.

5. A glove bag as defined in claim 4 in which said bags are dispensed for use from a continuous line in a container.

6. A glove bag as defined in claim 1 in which said compartments have connector tabs, which are attached to compartments of contiguous bags to form a continuous line of bags and said connector tabs are breakable to permit detachment of individual bags.

* * * * *